US005263829A

United States Patent [19]

Gergets

[11] Patent Number: 5,263,829

[45] Date of Patent: Nov. 23, 1993

[54] MAGNETIC DRIVE MECHANISM FOR A PUMP HAVING A FLUSHING AND COOLING ARRANGEMENT

[75] Inventor: Paul Gergets, Dyer, Ind.

[73] Assignee: Tuthill Corporation, Hinsdale, Ill.

[21] Appl. No.: 938,028

[22] Filed: Aug. 28, 1992

[51] Int. Cl.[5] ..... F04B 39/06

[52] U.S. Cl. ..... 417/420; 418/171

[58] Field of Search ..... 417/420, 373; 418/171

[56] References Cited

U.S. PATENT DOCUMENTS 3,238,878 3/1966 Martin .
3,736,075 5/1973 Otto .
4,013,384 3/1977 Oikawa .
4,047,847 9/1977 Oikawa .
4,065,235 12/1977 Furlong et al. .
4,080,112 3/1978 Zimmermann .
4,407,641 10/1983 Long .
4,871,301 10/1989 Buse .
5,165,868 11/1992 Gergets et al. ..... 417/420

*Primary Examiner*—Richard A. Bertsch
*Assistant Examiner*—David W. Scheuermann
*Attorney, Agent, or Firm*—Dennis M. McWilliams

[57] ABSTRACT

A magnetic drive mechanism and cooling system for driving a rotary pump having a magnetic rotary drive member with a recess therein. A magnetic rotary driven member is located in the recess of the drive member. A container is located between the drive member and the driven member for preventing the escape of cooling fluids circulated therein. Inlet and outlet fluid passages extend through the housing of the drive mechanism to the fluid containment area. Another fluid passage extends from the fluid containment area into the chamber of the pump. A cooling fluid is pumped through the fluid passages at a higher pressure than the pressure of the pumped fluid within the pump to prevent flow of the pumped fluid into the fluid passages and containment area of the drive mechanism to avoid contamination thereof while the cooling fluid is circulated to cool the driven member.

3 Claims, 1 Drawing Sheet

MAGNETIC DRIVE MECHANISM FOR A PUMP HAVING A FLUSHING AND COOLING ARRANGEMENT

BACKGROUND OF THE INVENTION

This invention relates to a magnetic drive mechanism for a pump having a flushing and cooling arrangement which allows for cooling and flushing of the magnetic surface of the rotary driven member.

It is common to use gear pumps with sealed magnetically coupled drives. Such magnetically coupled drives eliminate drive shaft seals, which are a major source of pump leakage and contamination of the environment. Generally, these types of pumps have a magnetic drive mechanism with a sealed housing separating the driving and driven members. A gap is provided between the driven member and the sealed cobtainer to allow for the circulation of cooling fluid to the rear portion of the rotary driven member and across the magnetic driven surface. Such a magnetically driven pump and drive mechanism is described in U.S. Pat. No. 5,165,868 issued Nov. 24, 1992.

Such magnetic drive mechanisms are sensitive to temperatures seen along the magnetic drive and driven surfaces. The magnets lose strength and efficiency as temperature increases. This problem is compounded because the magnets also lose strength as the distance between the inner and outer magnetic surfaces increases. Thus, it is common to keep the distance between the inner and outer magnetic surfaces to a minimum. However, keeping this distance to a minimum reduces the size of the gap between the fluid containment canister and the rotary driven member. Such a reduction in the width of the gap severely restricts circulation of the cooling fluid to the back side of the inner magnetic surface, thus resulting in increased temperature of the magnetic surface and decreased drive efficiency.

In addition, such magnetic drive mechanisms often use the fluid which is being pumped for circulation around the rotary driven member as the cooling fluid. In some instances the pumped fluid may contain harmful ingredients which have deleterious effects on the components of the magnetic drive mechanism when the pumped fluid is circulated through the magnetic drive mechanism resulting in premature wear and breakdown of the magnetic drive mechanism. In other instances the pumped fluid may contain contaminants, such that when the pumped fluid is circulated through the magnetic drive mechanism, the contaminants may build up in the cooling fluid passageways resulting in decreased circulation of the cooling fluid or the contaminants may completely block the cooling fluid passages. The contaminants from the pumped fluid may also build up on the magnetic surfaces of the drive mechanism causing damage and resulting in a loss of magnetic strength and a loss of drive efficiency.

SUMMARY OF THE INVENTION

A magnetic drive mechanism and cooling system is provided for driving a rotary pump to pump fluids. The arrangement provides a source of cooling fluid which is separated from the fluid being pumped and precludes entry of the pumped fluid into the circulation path of the cooling fluid. The drive mechanism includes a housing and a rotary drive member located in the housing. The rotary drive member includes a cup-shaped element defining a recess therein and a first magnetic surface. A rotary driven member, which is connectable to the rotary pump, is disposed for rotation within the recess of the rotary drive member. The rotary driven member includes a second magnetic surface and a hub. A container having a peripheral wall member with inner and outer surfaces is disposed between the drive member and the driven member. The housing includes a cooling fluid inlet port which is adapted for connection to a source of cooling fluid which is separate from the fluid being pumped. A first cooling fluid passage extends between the inlet port and the interior of the container. The hub includes a port which provides a second cooling fluid passage from a first side of the hub to a second side of the hub. A gap is defined between the driven member and the inner surface of the peripheral wall of the container. The gap defines a third cooling fluid passage which extends from a first side of the hub to a second side of the hub. The port in the hub and the gap combine to produce a fluid circulation path interior of the container to allow for constant fluid circulation between the first and second sides of the hub. A fourth cooling fluid passage extends between the interior of the container and the pump along the drive shaft of the pump to allow cooling fluid to flow under pressure from the interior of the container into the pump and thereby prevent inflow of the pumped fluid into the container. A cooling fluid outlet port is defined in the housing. A fifth cooling fluid passage extends between the interior of the container and the outlet port to allow the flow of cooling fluid from the interior of the container and out of the housing. The cooling fluid is pumped under pressure through the passages of the cooling fluid circulation path to cool and flush the magnetic drive mechanism and to prevent the pumped fluid from entering and contaminating the cooling fluid passageways, the interior of the container, and the components of the drive mechanism.

DETAILED DESCRIPTION OF THE PREFERRED EMBODIMENT

Figures 1, 2, 3:
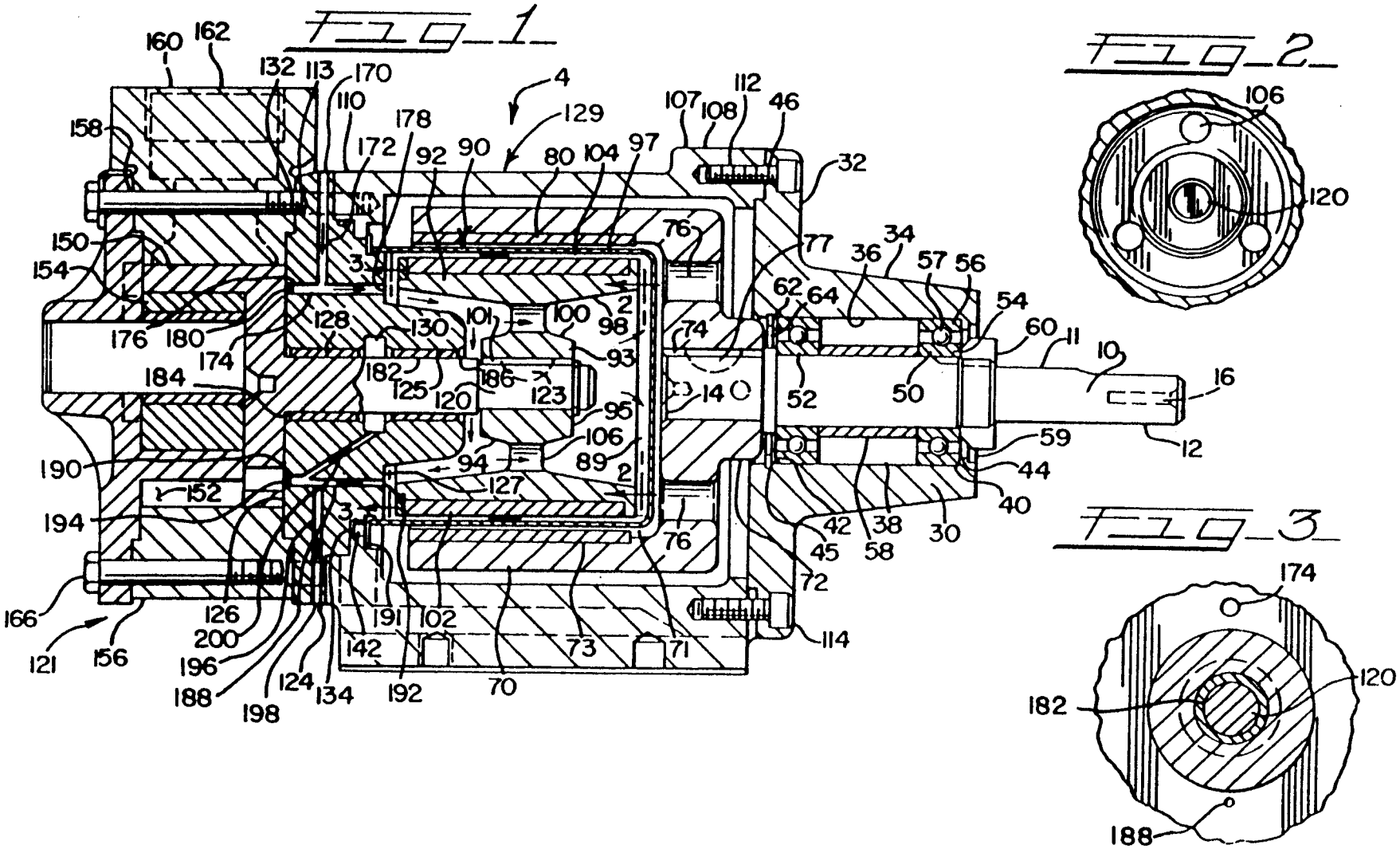
FIG. 1 is a cross section view, partially broken-away, of the magnetic drive mechanism of the present invention connected to a pump.
FIG. 2 is an end view, taken along the line 2—2 in FIG. 1.
FIG. 3 is an end view, taken along the line 3—3 in FIG. 1.

The present invention is directed to a magnetic drive mechanism and cooling system, generally depicted with the number 4, for driving a gear pump 121. As shown in FIG. 1, the drive mechanism 4 includes a shaft 10 adapted to be connected to an external power source. The shaft 10 includes a cylindrical outer surface 11 extending between a first end 12 and a second end 14. The first end 12 includes keyway 16, and the second end 14 includes a keyway (not shown). The drive mechanism 4 also includes a bearing housing 30. The bearing housing 30 includes a flange 32 and a stem 34. A bore 36 includes a cylindrical wall 38 and extends through the stem 34 and the flange 32. The wall 38 has a first end 40 and a second end 42. A circular lip 44 extends from the wall 38 and into the bore 36 at the first end 40 of the wall 38. A circular recess 45 is formed in the wall 38 at the second end 42 of the wall 38. A plurality of apertures 46 are located in the flange 32.

The shaft 10 extends through the bore 36 of the bearing housing 30 and is supported by bearings 50 and 52. Each bearing 50 and 52 includes an inner race 54, an outer race 56 and a plurality of spherical balls 57. The inner race 54 of each bearing 50 and 52 is located against the wall 38 and the outer race 56 of bearing 50 is located against the circular lip 44. Positioned between the inner races 54 of bearings 50 and 52 is a spacer 58 which encircles the shaft 10 and provides for proper spacing of the bearings 50 and 52. A lock washer 59 is situated within the circular lip 44. A lock nut 60 is affixed on top of the lock washer 59 to position and lock the bearings 50 and 52 in place. A spring 62 is situated between bearing 52 and a retaining ring 64 at the second end 42 of the wall 38. This spring 62 is compressed and held in place by retaining ring 64. The spring 62 and retaining ring 64 also provide proper preload of the bearings 50 and 52 and retain the bearings 50 and 52 in place.

A cup shaped rotary drive member 70 with a recess 71 therein, includes a stem 72 which is attached to the second end 14 of the shaft 10. The rotary drive member 70 has an interior surface 73. A bore 74 extends through the stem 72 of the rotary drive member 70. A plurality of apertures 76 extend through the rotary drive member 70. These apertures 76 reduce the weight of the rotary drive member 70 and may be used for circulating cooling fluid around the drive member 70 as disclosed in U.S. Pat. No. 5,165,868, issued Nov. 24, 1992. The shaft 10 extends into bore 74 and is affixed thereto by a woodruff key 77 or any of a number of other connections. A magnetic drive surface 80 which includes a series of magnets is attached to the interior surface 73 of the rotary drive member 70.

A thin containment can 90, which provides a sealed fluid containment area 89, is disposed within the recess 71 in close proximity to the magnetic surface 80. A flange 91 extends around the open edge of the containment can 90 and provides an engagement surface. A rotary driven member 92 is rotatably disposed within the containment can 90. The containment can 90 includes a peripheral wall member 97 having an inner surface and an outer surface. The wall member 97 is disposed between the drive member 70 and the driven member 92. The driven member 92 includes a hub 93 which has a first side 94 and a second side 95. This hub 93 includes a flange 98 and an annular member 100 with a bore 101 therethrough. Attached to the periphery of the flange 98 is a magnetic driven surface 102. The dimensions of the hub 93, the magnetic surface 102 and the containment can 90 are arranged so that a gap 104 is formed between the magnetic surface 102 and the containment can 90. This gap generally ranges in dimension between 0.040 and 0.080 inches for most pump sizes. One or more ports 106 are provided through the hub 93 intermediate the flange 98 and the annular member 100. FIG. 2 shows three such ports but the number, size and arrangement of such ports are dependent upon the specifics likely to be incurred for the particular pump which is being driven.

The drive mechanism 4 includes an adapter 107 which extends around the rotary drive member 70. The adapter 107 includes a first side 108 and a second side 110. A plurality of threaded apertures 112 are located in the first side 108 of the adapter 107. A plurality of apertures 113 are located in the second side 110 of the adapter 107. The adapter 107 is attached to the bearing housing 30 by screws 114 which extend through apertures 46 in the flange 32 of the bearing housing 30 and into the threaded apertures 112 located in the first side 108 of the adapter 107.

The drive mechanism 4 includes a bracket 124 for attachment to the adapter 107. The bracket 124, adapter 107 and the bearing housing 30 form a drive housing 129 which encloses the driven member 92, the drive member 70 and the containment can 90. The bracket 124 includes a bore 125 therethrough along the central axis of the bracket 124. The bracket 124 includes a first side 126 and a second side 127. Two bushings 128 are located in the bore 125. Each bushing 128 includes an inner surface and an outer surface. A recess 130 is formed in the bore 125. A plurality of threaded apertures 132 are located in the bracket 124. A circular recess 134 is formed in the bracket 124 at the second side 127 of the bracket 124. The containment can 90 is attached to the second side 127 of the bracket 124 by the flange 91 located at the open edge of the containment can 90 which compresses an O-ring 142 located in the circular recess 134 at the second side 127 of the bracket 124 to contain fluid within the can and prevent leakage to the environment.

The rotary gear pump 121 which is driven by the drive mechanism 4 can be of any type commonly known in the art. An input shaft 120 of the gear pump 121 extends into the bore 101 in the annular member 100 of the hub 93, and is attached to the hub 93 by use of a key 123 and keyway arrangement. The input shaft 120 of the rotary pump 121 is attached to drive the outer gear 150 which is located within a chamber 152. An inner gear 154 engages the outer gear 150 in conventional manner. A housing 156 is attached to the first side 127 of the bracket 124. The housing includes a plurality of apertures 158, an inlet port 160 and an outlet port 162. Screws 166 extend through apertures 158 and into threaded apertures 132 and 113 and hold the pump housing 156, the bracket 124 and the adapter 110 together.

The drive housing 129 includes a plurality of fluid passages which form circulation paths for the passage of cooling fluid. An inlet port 170 is provided in the exterior rim of the bracket 124. The inlet port 170 is accessible from the exterior of the bracket 124 and is adapted for connection to a source of cooling fluid. A fluid passage 172 extends within the bracket 124 from the inlet port 170 to a fluid passage 174. The fluid passage or path 174 extends within the bracket 124 from a first port 176 located at the first side 126 of the bracket 124 to a second port 178 located at the second side 127 of the bracket 124. The first port 176 is sealed fluid tight by a threaded pipe plug 180 and the second port 178 is in fluid communication with the fluid containment area 89 within the container 90. The fluid passages 172 and 174 form a cooling fluid path from the inlet port 170 to the fluid containment area 89. A fluid passage or path 182 extends from the fluid containment area 89 to the chamber 152 within the pump 121. The fluid passage 182 is located between the shaft 120 of the pump 121 and the inner surface of the bushings 128, and extends between a first port 184 located at the first side 126 of the bracket 124 and a second port 186 located at the second side 127 of the bracket 124. As will be understood by those familiar with the art fluid is allowed to pass from the port 184 into the pumping chamber 152 between the clearances provided between the gear 150 and the bracket 124. The fluid passage 182 forms a cooling fluid path from the fluid containment area 89 to the chamber 152 within the pump 121. The fluid passage 182 is also in fluid communication with the recess 130. A fluid passage or path 188 extends within the bracket 124 from a first port 190 located at the first side 126 of the bracket 124 to a second port 192 located at the second side 127 of the bracket 124. The fluid passage 188 is located diametrically opposite the bore 125 from the fluid passage 174. The first port 190 of the fluid passage 188 is sealed fluid tight by a threaded pipe plug 194. The fluid passage 188 is in fluid communication with a fluid passage 196. The fluid passage or path 196 extends from the fluid passage 188 to an outlet port 198 located in the exterior rim of the bracket 124. The fluid passages 188 and 196 form a cooling fluid path from the fluid containment area 89 within the container 90 to the outlet port 198. The outlet port 198 is accessible from the exterior of the bracket 124 and provides for the outflow of cooling fluid from the bracket 124. A fluid passage or path 200 extends from the fluid passage 182 at the recess 130 to the fluid passage 188. The fluid passages 172, 174, 182, 188, 196 and 200 and the fluid containment area 89 form a fluid circulation path extending from the inlet port 170, to and around the driven member 92, and then to the outlet port 198 which passes cooling fluid to the exterior of the bracket 124. Additional fluid passages or paths may be provided in the bracket 124 as desired to provide for the inflow and outflow of cooling fluid from the fluid containment area 89.

The operation of the magnetic drive mechanism 4 as shown in FIGS. 1–3 will now be explained. Energization of a power source rotates shaft 10, to which it is connected, and the rotary drive member 70 with the magnetic surface 80 attached thereto. The magnetic attraction between surfaces 80 and 102 causes rotation of the driven member 92 in a well known manner and thus causes rotation of input shaft 120. The rotation of the input shaft 120 rotates the outer gear 150 of the rotary pump 121. Rotation of the outer gear 150 produces a pumping action in a well known manner which draws the pumped fluid into the chamber 152 through the inlet port 160 and pumps fluid out of the chamber 152 through the outlet port 162.

A source of cooling fluid external to the drive mechanism 4 is connected to the inlet port 170. The cooling fluid is pumped under pressure through the inlet port 170, through the fluid passage 172 and through the connecting fluid passage 174 into the fluid containment area 89 within the container 90. The cooling fluid within the fluid containment area 89 circulates from the first side 94 of the hub 93 to the second side 95 of the hub 93 through the ports 106 and the cooling fluid returns to the front side 94 of the hub 93 via the gap 104. As the cooling fluid is circulated throughout the fluid containment area 89 and around the driven member 92, and as additional cooling fluid is pumped through the inlet port 170, cooling fluid from the fluid containment area 89 will flow through the second port 192 into the fluid passage 188. Cooling fluid from the fluid containment area 89 will also flow through the port 186 and into the fluid passage 182. The cooling fluid that flows into the fluid passage 182 passes along and around the shaft 120 of the pump 121 to the recess 130. A portion of the cooling fluid in the recess 130 will flow through the fluid passage 200 into the fluid passage 188. The remaining portion of the cooling fluid which enters the recess 130 will continue to flow through the fluid passage 182 and under pressure into the chamber 152 of the pump 121 through the first port 184. The cooling fluid which passes through the fluid passage 182 provides lubrication and cooling for the bushings 128 and the input shaft 120. The cooling fluid which enters the fluid passage 188 from the fluid passage 200 and from the fluid containment area 89 flows into the interconnecting fluid passage 196 to the outlet port 198. The cooling fluid flowing out of the drive mechanism 4 through the outlet port 198 may be filtered and cooled and returned to the inlet port 170 for recirculation through the fluid circulation path of the drive mechanism 4.

The cooling fluid which flows through the fluid passages and fluid containment area 89 of the fluid circulation path is pumped at a pressure which exceeds the pressure of the pumped fluid which is within the pump 121. The higher pressure of the cooling fluid relative to the pressure of the pumped fluid forces a small amount of the cooling fluid from the fluid containment area 89 to flow into the pump 121, thereby preventing any of the pumped fluid in the pump 121 from flowing into the fluid circulation path of the drive mechanism 4 which could contaminate the drive mechanism 4 or clog the fluid circulation path with contaminants. The pipe plugs 180 and 194 prevent the pumped fluid within the pump 121 from entering the fluid passages 174 and 188.

As a small portion of the cooling fluid which is pumped into the fluid circulation path flows into the pump 121 through the fluid passage 182, whereupon this cooling fluid is intermixed with the pumped fluid and is pumped out of the pump outlet port 162, the flow rate of cooling fluid exiting the drive mechanism 4 through the outlet port 198 will be smaller than the flow rate of cooling fluid being pumped into the inlet port 170. Therefore, when the cooling fluid which exits the outlet port 198 is intended to be recirculated through the drive mechanism 4, additional cooling fluid should be available to make up for the volume of cooling fluid which flows into the pump 121 through the fluid passage 182. As the cooling fluid and the pumped fluid become intermixed in the pump 121, the cooling fluid and the pumped fluid should be compatible with one another.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A magnetic drive mechanism and cooling system for a rotary gear pump including a drive housing; a rotary drive member consisting of a cup-shaped element defining a recess therein; a first magnetic surface carried by said drive member positioned in said housing; a rotary driven member disposed for rotation in said recess of said rotary drive member, said driven member being connectable to the rotary gear pump; a second magnetic surface carried by said driven member and positioned adjacent to said first magnetic surface; a container having a peripheral wall member with inner and outer surfaces disposed between said drive member and said driven member, said container defining a fluid containment area within said container; a cooling fluid inlet port adapted to be connected to a source of pressurized cooling fluid; a first cooling fluid path extending through said housing between said cooling fluid inlet port and said fluid containment area within said container; a second cooling fluid path extending between said fluid containment area within said container and the rotary gear pump for allowing a portion of said cooling fluid to flow from said fluid containment area into the rotary gear pump; a cooling fluid outlet port defined in said housing adapted to carry to carry cooling fluid out of said housing; a third cooling fluid path extending between said fluid containment area within said container and said cooling fluid outlet port; whereby during operation of the pump the cooling fluid is pumped through said cooling fluid paths to provide cooling of said rotary driven member and the pressure of the cooling fluid exceeds the pressure of the pumped fluid thereby allowing passage of a portion of the cooling fluid into the pump and precluding entry of the pumped fluid into the cooling fluid circulation path.

2. The magnetic drive mechanism of claim 1 additionally including a hub forming part of said rotary driven member; a port defined through said hub to provide a fourth cooling fluid path from a first side of said hub to a second side of said hub; a gap defined between said driven member and said inner surface of said peripheral wall member of said container, said gap defining a fifth cooling fluid path between a first side of said hub and a second side of said hub, whereby said hub port and said gap combine to produce a fluid circulation path interior to said container to allow for constant fluid circulation between said first side of said hub and said second side of said hub through said hub port and said gap thereby providing cooling of said rotary driven member.

3. The magnetic drive mechanism of claim 2 additionally including a sixth cooling fluid path extending between said second cooling fluid path and said third cooling fluid path.

* * * * *